US005572746A

United States Patent [19]

Linico

[11] Patent Number: 5,572,746

[45] Date of Patent: Nov. 12, 1996

[54] COMBINED HAIRDO SPACER AND PROTECTIVE DEVICE

[76] Inventor: Lorraine Linico, 314-A Rte. 31, R.R. #14, Flemington, N.J. 08822

[21] Appl. No.: 450,483

[22] Filed: May 26, 1995

[51] Int. Cl.[6] ..... A42C 5/02

[52] U.S. Cl. ..... 2/182.1; 2/182.2; 2/182.6; 2/DIG. 11

[58] Field of Search ..... 2/171, 174, 181, 2/182.1, 182.3, 182.6, 209.3, DIG. 11, 181.2, 181.4, 182.2

[56] References Cited

U.S. PATENT DOCUMENTS

| | | | |
|---|---|---|---|
| 3,014,220 | 12/1961 | Weld | 2/171 |
| 3,179,954 | 4/1965 | Weitzner | 2/175.3 |
| 3,618,140 | 11/1971 | Goldfarb . | |
| 3,962,728 | 6/1976 | Pavlinik . | |
| 4,790,035 | 12/1988 | Whyte . | |
| 4,951,320 | 8/1990 | Yoon | 2/195.1 |

FOREIGN PATENT DOCUMENTS 723031 2/1955 United Kingdom .

*Primary Examiner*—Diana Biefeld
*Attorney, Agent, or Firm*—Kenneth P. Glynn

[57] ABSTRACT

The present invention involves a hairdo spacer and protective device having a headband, which can be used alone or in combination with at least one arc wherein each arc forms an arch over the base headband and is attached to the base headband by an attaching means. Both the base headband and arcs, if any, have a spacing means for spacing the base headband and arcs, if any, away from a person's hairdo or scalp.

18 Claims, 2 Drawing Sheets

COMBINED HAIRDO SPACER AND PROTECTIVE DEVICE

BACKGROUND OF THE INVENTION

1. Field of the Invention

The present invention relates to a headgear and, more particularly, to a headband or item of headgear that allows hats and other protective devices to be worn while keeping a hairdo intact and also provides a volume-look to hair.

2. Information Disclosure Statement

Various types of headgear devices have been developed, which include turban type headgear and arch type supports. The following patents show various prior art headgear.

U.S. Pat. No. 3,618,140 to Goldfarb discloses a scarf hat composed of a thin sheet of fibrous material, which corner portions are successfully folded, stitched and gathered together around a filler insert to form the appearance of a bonnet.

U.S. Pat. No. 3,962,728 to Pavlinik describes and illustrates a head turban for confining hair before or after washing or while sleeping. It includes a one piece unit having velcro tab assemblies which allow for size adjustment. A tie string assembly permits a band portion of the head turban to tightly engage the nape of the neck.

U.S. Pat. No. 4,790,035 to Whytes discloses a headgear which prevents hair from becoming wet or disturbed. It includes an elongate strip of material having two arms with at least one of said arms being looped around the other. The loop is arranged so that one arm can be pulled through the other arm to alter the "hat size" of the headgear.

British Patent No. 723,031 relates to a headgear which is decorative and obtains a firm grip on the head. It includes a foundation comprising two or more springy arch shaped strips which are connected.

Notwithstanding the above prior art, there is no reference which teaches or suggests the present invention wherein the base headband and the arcs have a spacing means for spacing the base headband and arcs away from a hairdo so that a protective covering can be worn without messing the hairdo. In addition, the spacing means raises up and changes the position of hair making it appear more voluminous.

SUMMARY OF THE INVENTION

The present invention involves a hairdo spacer and protective device having an approximately circular shaped headband, which can be used alone or in combination with at least one arc forming an arch over the base headband and which is attached to the base headband by an attaching means. Both the base headband and arcs, if any, have a spacing means for spacing the base headband and arcs, if any, from a person's hairdo allowing a protective covering to be worn while leaving the hairdo intact. The base headband can also be used to rearrange a person's hair by pushing it back from the forehead and over the base headband causing the hair to look more voluminous because of the spacing means.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention relates to a headgear and, more particularly, to a headband or item of headgear that allows hats and other protective devices to be worn while keeping a hairdo intact and also provides a volume-look to hair. The present invention involves a hairdo spacer and protective device which fits around a person's head, either around the forehead and below the crown or pushed back at a front hairline and around the nape of the neck.

It has a base headband with at least one arc attached to the base headband and can be used simply as the base headband or with the combination of base headband and at least one arc. The base headband and arcs, if any, all contain a spacing means for spacing the base headband and arcs, if any, from a person's hairdo, thereby allowing a protective covering to be worn while leaving the hairdo intact. In addition, when the base headband is worn alone pushed back from the forehead and around the nape of the neck, hair can be rearranged by pushing it back from the forehead and over the base headband causing hair to look more voluminous.

The spacing means is a plurality of probes with each probe being a pin with a beaded end or each probe being a plurality of detachable flexible tips. The pins with beaded ends are made in various sizes and are changeable for different length hair. They can be bracketed with a plurality of pins attached to the bracket. Each flexible tip on the other type probe can be cut off to allow for different length hair.

Figure 1:
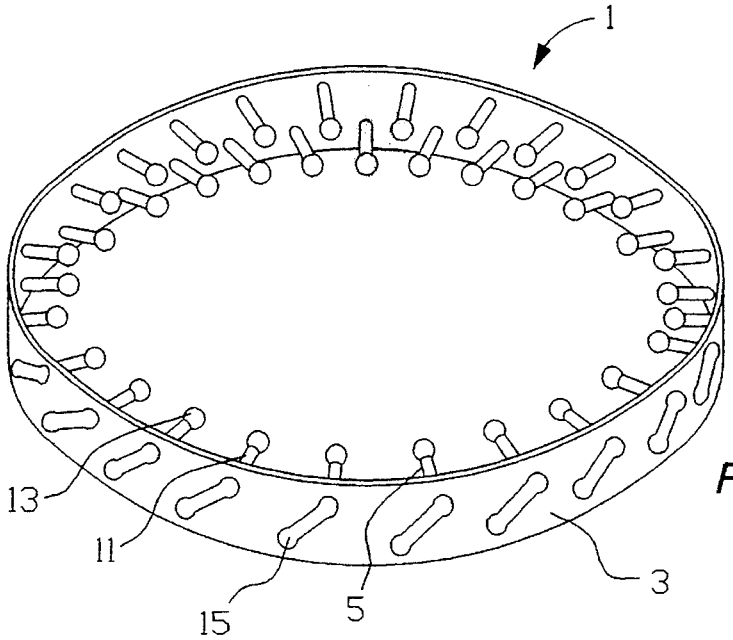
FIG. 1 shows a perspective view of a present invention combined hairdo spacer and protective device having a base headband.

Referring to FIG. 1, there is shown a combined hairdo spacer and protective device 1 having an approximately circular-shaped base headband 3, which is sized to fit around an average person's head. The base headband 3 includes an elongate strip (not shown) connected at the ends by a fastening means (not shown) and a springy element 107 surrounded by a smooth material 109 (see FIG. 6). The springy element 107 can be made from a flexible, plastic material such as a cross stitching material. The smooth material 109 can be a cloth. The fastening means can be a filamentary loop and hook mechanism such as VELCRO® fastener, a plastic snap, staples or the like.

Protruding from the base headband 3 is a spacing means, in this case, a plurality of probes 5. Each of the probes 5 is small and lightweight. Depending upon where the base headband 3 is placed on a person's head, the plurality of probes 5 either creates a barrier between a person's pushed back hair and the base headband 3 or a top of a person's hairdo and the base headband 3.

The plurality of probes 5 can be staggered or straight relative to a longitudinal axis through the base headband 3.

Figure 3:
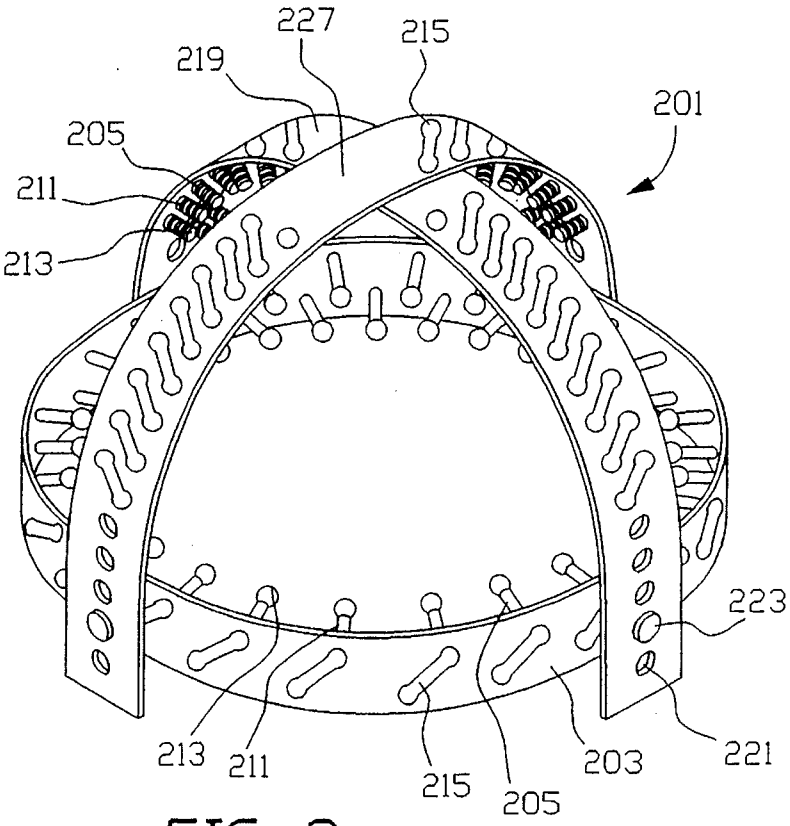
FIG. 3 shows a perspective view of a present invention combined hairdo spacer and protective device having a base headband and two overhead arcs.
Figure 2:
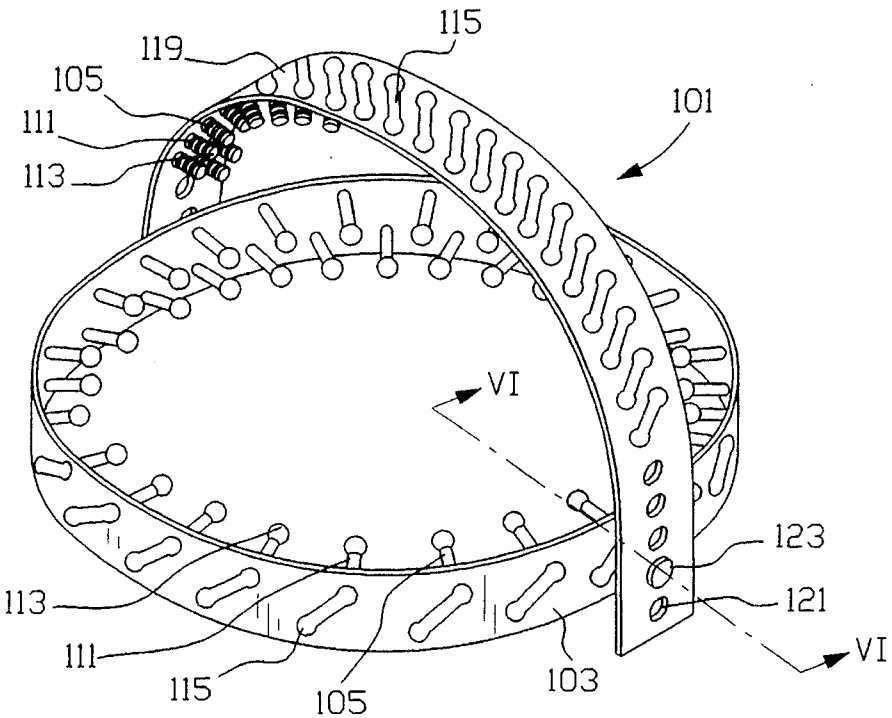
FIG. 2 shows a perspective view of a present invention combined hairdo spacer and protective device having a base headband and one overhead arc.

When the plurality of probes 5 is staggered as shown in FIGS. 1, 2 and 3, a fewer number of probes 5 are required to provide the support needed to keep the base headband 3 stable when placed on or over the head. When the probes 5 are straight, more probes 5 are needed to require the support. The probes 5 can be individually connected to the base hairband 3 or can be bracketed with two or more probes 5 connected together to the base hairband 3 to form bracketed probes 25. The probes 5 can be made in different lengths and also be changeable so that the device can be custom fitted for long and short hair.

Figure 5:
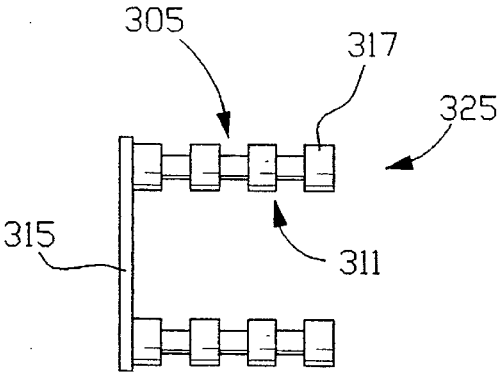
FIG. 5 shows a side view of a bracketed probes, each probe having a plurality of flexible tips.

Referring to FIG. 2, there is shown a present invention 101 having an arc 119 attached to a base headband 103. Like parts are numbered as in FIG. 1 but incremented by 100. The arc 119 includes a springy material surrounded by a smooth material, a plurality of holes 121 located at each end of the arc 119 and a spacing means, in this case, a plurality of probes 105 with each probe having a pin 111 with a beaded end 113. The spacing means could also be a plurality of probes with each probe being a plurality of flexible tips as shown in FIG. 5. In this embodiment, the base headband 103 also includes a hook arm 123, which attaches the arc 119 to the base headband 103 at each end by way of a given one of the holes 121 at each end.

Referring to FIG. 3, there is shown a present invention with two arcs 219, 227 attached to a base headband 203. The arcs 219, 227 criss-cross at a midpoint of a length of each arc 219, 227. Like parts are numbered as in FIG. 2 but incremented by 100.

Figure 4:
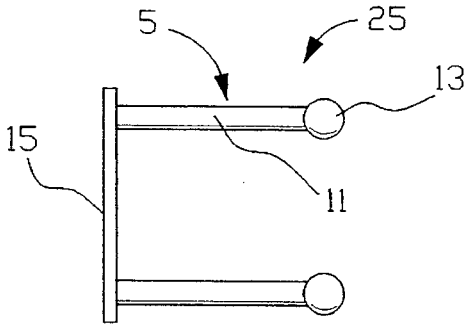
FIG. 4 shows a side view of bracketed probes, each probe having a pin with a beaded end.

Referring to FIGS. 4 and 5, there is shown a side view of two types of bracketed probes 25, 325, respectively. As shown in FIG. 4, the bracketed probes 25 include a pair of probes 5 removeably connected to a bracket 15 located on a side of the base headband 3 opposite the probes 5. Each probe 5 includes a straight pin-like portion 11 and a beaded end 13. The straight portion 11 can be made from a rubber or a steel. The beaded end 13 can be made from a rubber. The pins 11 may be made in various sizes and can be changeable by the user, thereby allowing the device to be custom fitted for long and short hair. The bracket 15 may also be integrally connected to the straight portion 11, such as in the use of a staple.

As shown in FIG. 5, the bracketed probes 325 include a pair of probes 305 connected by a bracket 315. Each probe 305 includes a plurality of flexible tips 317 with each tip being detachable, thereby providing an adjustment for variable length hair.

Figure 6:
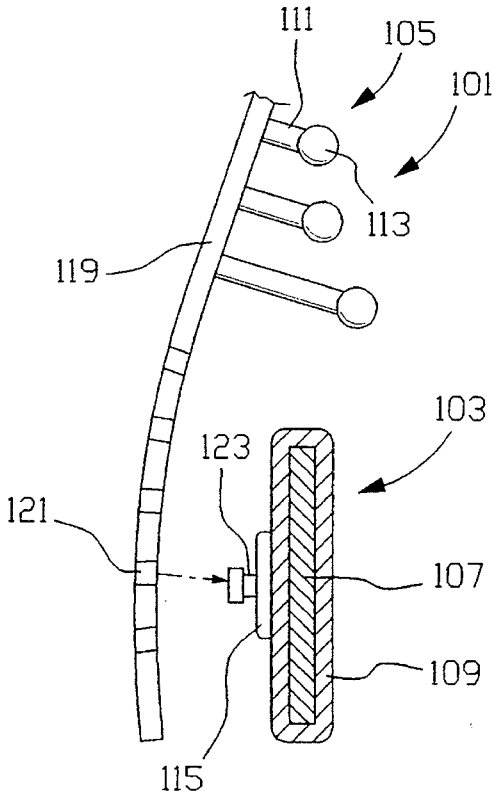
FIG. 6 shows a cross section of the present invention show in FIG. 2 taken along line VI—VI.

FIG. 6 shows a cross section of the device 101 shown in FIG. 2. The base headband 103 includes the springy element 107 surrounded by a smooth material 109 and the hook arm 123. The arc 119 is made out of the same elements as the base headband 103. The arc 119 includes a plurality of probes 105 with each probe containing a pin 111 with a beaded end 113 and a plurality of holes for attaching the arc 119 to the hook arm 123. The probes 105 are different lengths so that the device can be custom fitted for long and short hair. The device 101 can either be individually fitted with different length probes 105 by the user or the device 101 can be bought in various lengths of probes 105.

In operation, when the device 1 is placed over the scalp on a top front part of the hairline and around the nape of the neck, the plurality of probes 5 creates a barrier between the hair underneath the device 1 and the hair which is pushed back and over the base headband 3 causing the hair to appear to be more voluminous by raising it up.

When the device 1, 101 and 201 is worn with a protective cover, such as a hat or rainwear, the device 1, 101 and 201 is positioned so that a back portion of the base headband 3, 103, 203 is below the crown over the hair and a front portion of the base headband 3, 103, 203 is over bangs or the forehead hairline, in the absence of bangs. The probes 105, which are small and lightweight, form a barrier between the hairdo and the base headband 3, 103,203 and cause the hair to remain intact when a protective covering is placed over the device 3, 103, 203.

Obviously, numerous modifications and variations of the present invention are possible in light of the above teachings. It is therefore understood that within the scope of the appended claims, the invention may be practiced otherwise than as specifically described herein.

What is claimed is:

1. A combined hairdo spacer and protective device which comprises:

(a) an elongate strip having a fastening means for fastening an end with another end to form an approximate circular shaped base headband, said base headband having a flexible characteristic and a circumference sized to fit around a person's head;

(b) at least one arc connected to said base headband, said at least one arc forming an arch over said base headband and having an attaching means for attaching said at least one arc to said base headband and having a flexible characteristic; and (c) a spacing means for spacing said base headband and said at least one arc, said spacing means including a plurality of probes wherein each probe includes a pin with a beaded end and wherein said spacing means forms a barrier between said base headband and said at least one arc, and a person's hairdo whereby a protective covering can be worn over said device while leaving the hairdo intact.

2. The device of claim 1 wherein said pin is made from the group consisting of rubber or steel.

3. The device of claim 2 wherein said beaded end is made from rubber.

4. The device of claim 3 wherein said pin is removably attached to said base headband.

5. The device of claim 3 wherein at least two said probes are attached to a bracket mounted on a side of said base headband or on a side of said at least one arc opposite said probes.

6. The device of claim 5 wherein said at least one arc crosses another said at least one arc.

7. The device of claim 6 wherein said attaching means comprises a plurality of holes for engaging a hook arm with one of said plurality of holes.

8. The device of claim 7 wherein said plurality of holes provides for variable height adjustment of said at least one arc.

9. A combined hairdo spacer and protective device which comprises the following elements:

(a) an elongate strip with a fastening means for fastening an end with another end to form an approximate circular shaped base headband, said base headband having a flexible characteristic and a circumference sized to fit around a person's head; and (b) a spacing means for spacing said base headband, said spacing means including a plurality of probes wherein each probe includes a pin with a beaded end and wherein said spacing means forms a barrier between said base headband and a person's hair and when said device is pulled back over the hair from the forehead and placed under the hair at the neckline and when the hair pushed back from the forehead is placed over the device toward the forehead, the hair looks fuller.

10. The device of claim 9 wherein said pin is made from the group consisting of rubber or steel.

11. The device of claim 10 wherein said beaded end is made from rubber.

12. The device of claim 11 wherein said pin is removably attached to said base headband.

13. The device of claim 11 wherein at least two said probes are attached to a bracket mounted on a side of said base headband.

14. A combined hairdo spacer and protective device which comprises the following elements:

(a) an elongate strip member with a fastening means for fastening an end with another end to form an approximate circular shaped base headband, said base headband having a flexible characteristic and a circumference sized to fit around a person's head; and (b) a spacing means for spacing said base headband, said spacing means including a plurality of probes wherein each probe includes a pin with a beaded end and wherein said spacing means forms a barrier between said base headband and a person's hairdo whereby a protective covering can be worn over said device while leaving the hairdo intact.

15. The device of claim 14 wherein said pin is made from the group consisting of rubber or steel.

16. The device of claim 15 wherein said beaded end is made from rubber.

17. The device of claim 16 wherein said pin is removably attached to said base headband.

18. The device of claim 16 wherein at least two said probes are attached to a bracket mounted on a side of said base headband.

* * * * *